United States Patent [19]

Chaussadas

[11] 4,382,506

[45] May 10, 1983

[54] MULTI UNIT PACKAGE INCORPORATING WRAP-AROUND HANDLE

[75] Inventor: Jean Chaussadas, Deols, France

[73] Assignee: The Mead Corporation, Dayton, Ohio

[21] Appl. No.: 241,863

[22] Filed: Mar. 9, 1981

[30] Foreign Application Priority Data

Mar. 12, 1980 [GB] United Kingdom ..... 8008282
Jan. 28, 1981 [GB] United Kingdom ..... 8102591

[51] Int. Cl.[3] ..... B65D 75/00; B65D 65/00

[52] U.S. Cl. ..... 206/200; 206/428; 206/432; 229/52 BC

[58] Field of Search ..... 206/432, 434, 200, 597, 206/428; 229/52 BC, 89

[56] References Cited

U.S. PATENT DOCUMENTS

| | | | |
|---|---|---|---|
| 2,290,969 | 7/1942 | King | 206/434 |
| 3,214,016 | 10/1965 | Stephan | 206/432 |
| 3,219,183 | 11/1965 | Potter et al. | 206/432 |
| 3,451,543 | 6/1969 | Graser et al. | 206/434 |
| 3,463,306 | 8/1969 | Taylor | 206/432 |
| 3,557,516 | 1/1971 | Brandt | 206/432 |
| 3,674,136 | 7/1972 | Forrer | 206/432 |
| 3,963,121 | 6/1976 | Kipp | 206/434 |
| 4,215,781 | 8/1980 | Humphries et al. | 206/434 |

*Primary Examiner*—Joseph Man-Fu Moy
*Attorney, Agent, or Firm*—Erwin Doerr

[57] ABSTRACT

The invention provides a package comprising a plurality of primary containers, such as bottles or cans, connecting means for holding said containers clustered together to form a unit, and an outer sleeve of paperboard passing around at least one such clustered unit, said outer sleeve providing handle means by which the package can be grasped and carried.

10 Claims, 19 Drawing Figures

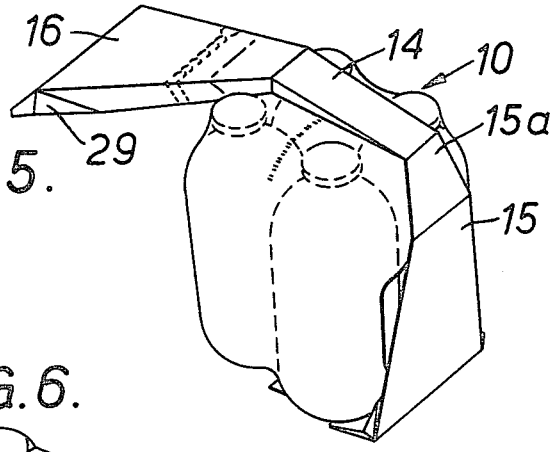
FIG. 5.
FIG. 6.
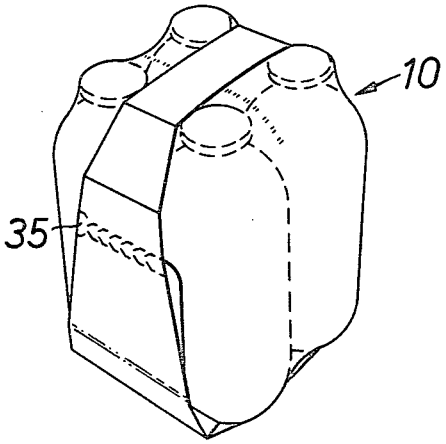
FIG. 7.
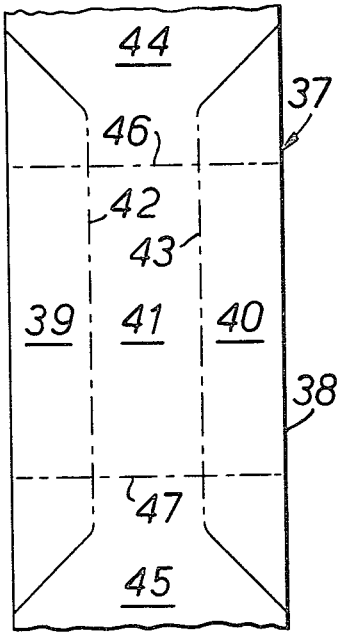

MULTI UNIT PACKAGE INCORPORATING WRAP-AROUND HANDLE

This invention relates to a multi-unit package for retaining a plurality of primary containers such as bottles or cans and which incorporates a wrap-around handle device.

It is well known to package a plurality of containers by the application of a shrink fitted plastics material to form a closely clustered unit of containers. Normally, however, a number of such units are then packaged in an outer carton or tray to facilitate transport and distribution of the packages. At point-of-sale it is inconvenient and often difficult for a customer to grasp one of the packaged units since handles are not provided.

It is further well known to package a plurality of containers by means of a wrap-around sleeve formed from paperboard or similar material. Such sleeves normally incorporate handle means by which the package can be grasped and carried. However, such packages are susceptible to the effects of moisture which can weaken the sleeve and cause dislodgement of the containers.

The present invention seeks to overcome the disadvantages of these known packages whilst also incorporating their known advantages.

To this and the invention provides a package comprising a plurality of primary containers such as bottles or cans, connecting means for holding said containers clustered together to form a unit and an outer sleeve passing around at least one such clustered unit said outer sleeve providing handle means by which the package can be carried.

Figure 1:
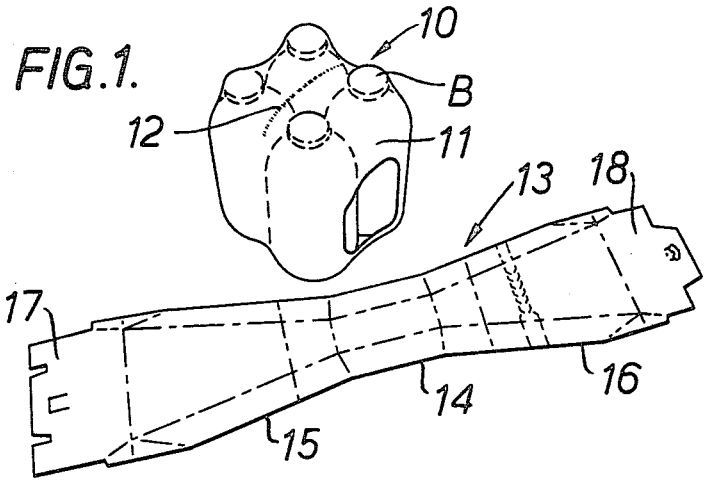
Figure 2:
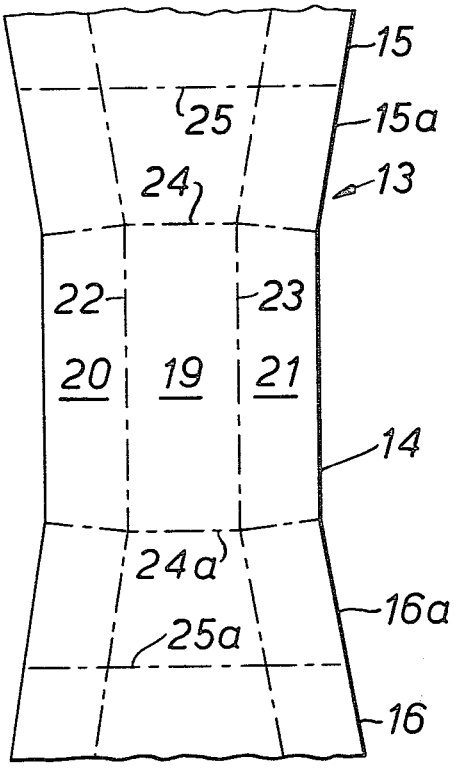
Figure 3:
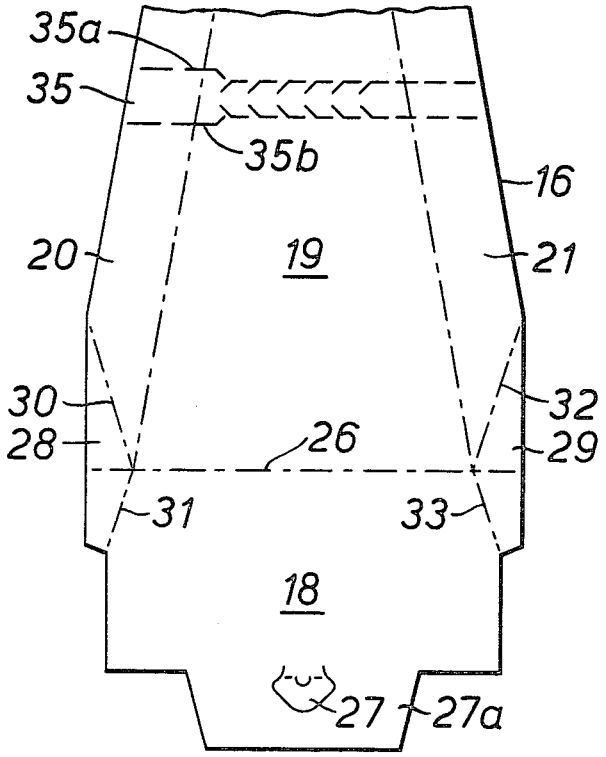
Figure 4:
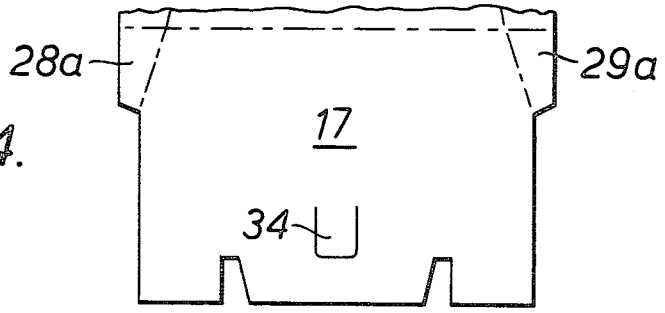
Figure 8:
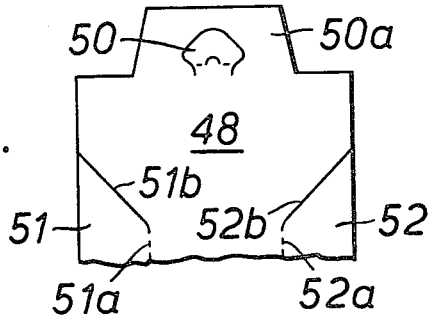
Figure 9:
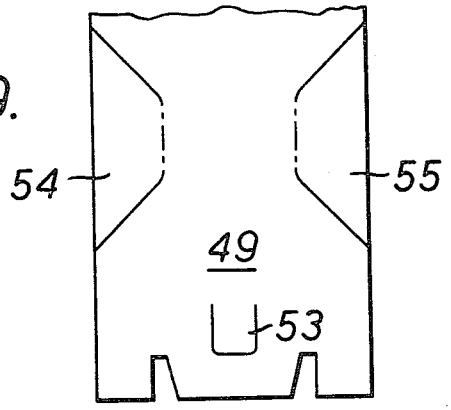
Figure 10:
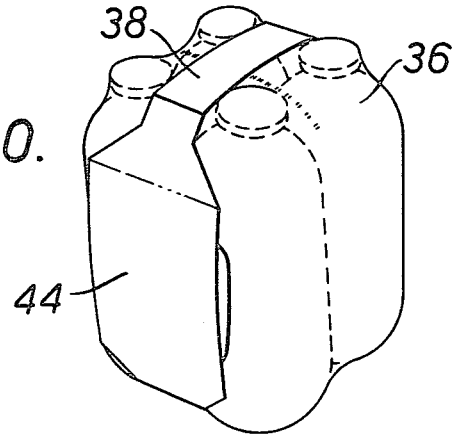
Figure 13:
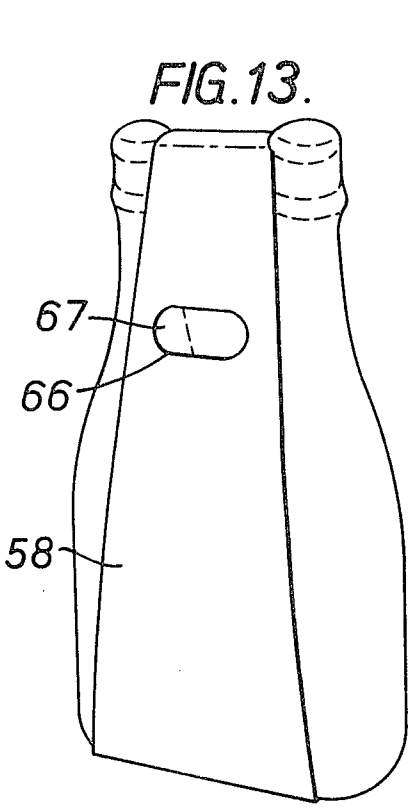
Figure 11:
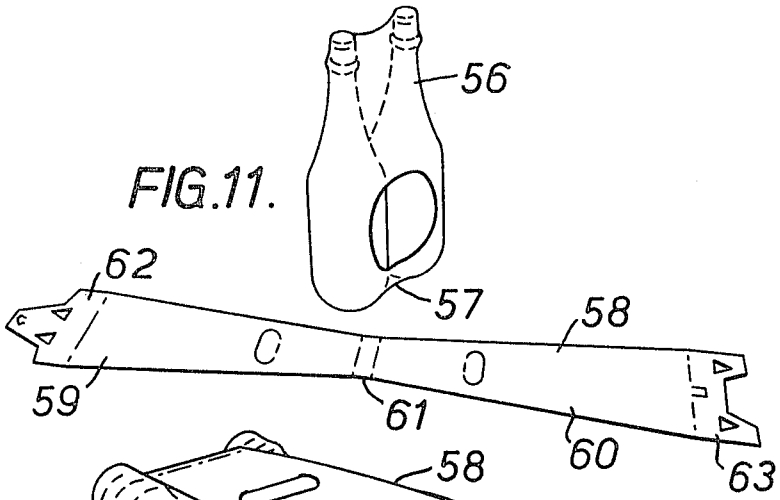
Figure 12:
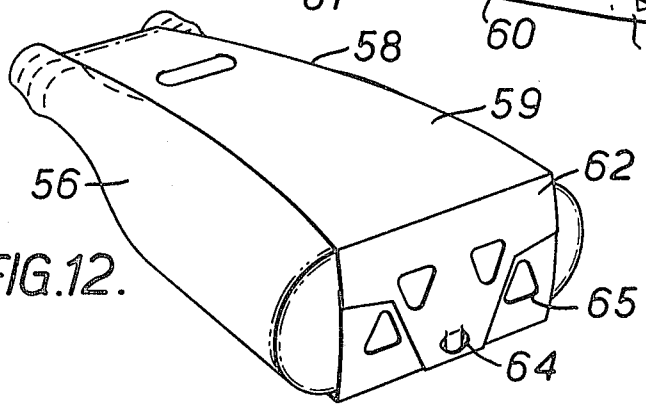
Figure 14:
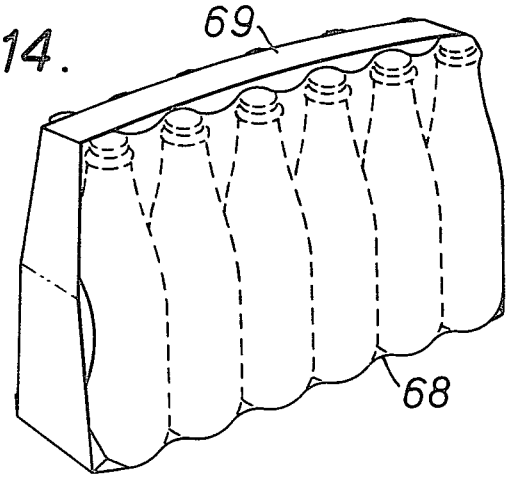
Figure 15:
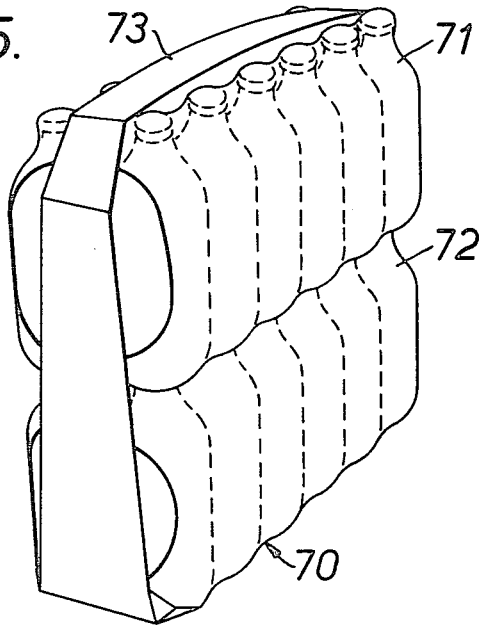
Figure 16:
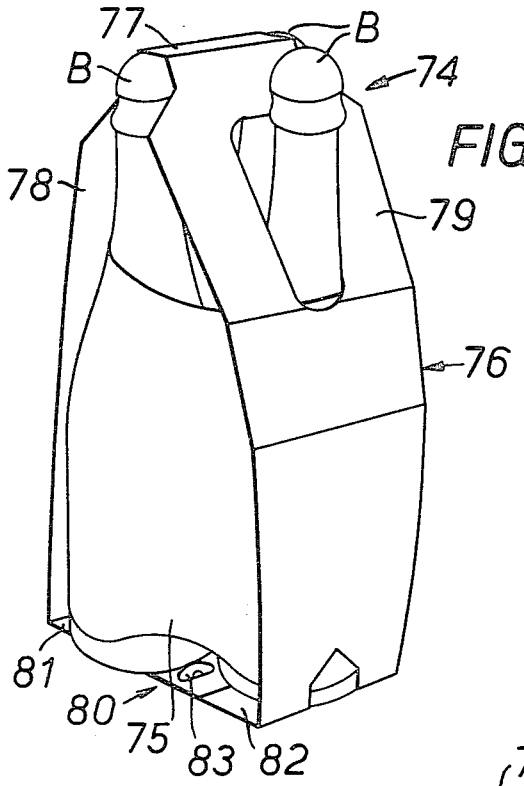
Figure 17:
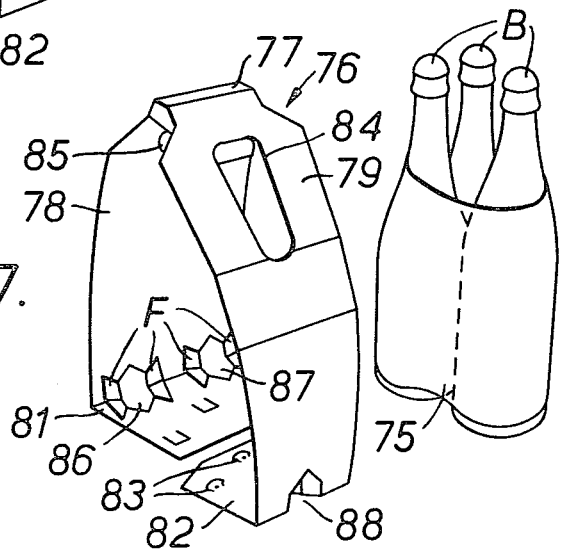
Figure 18:
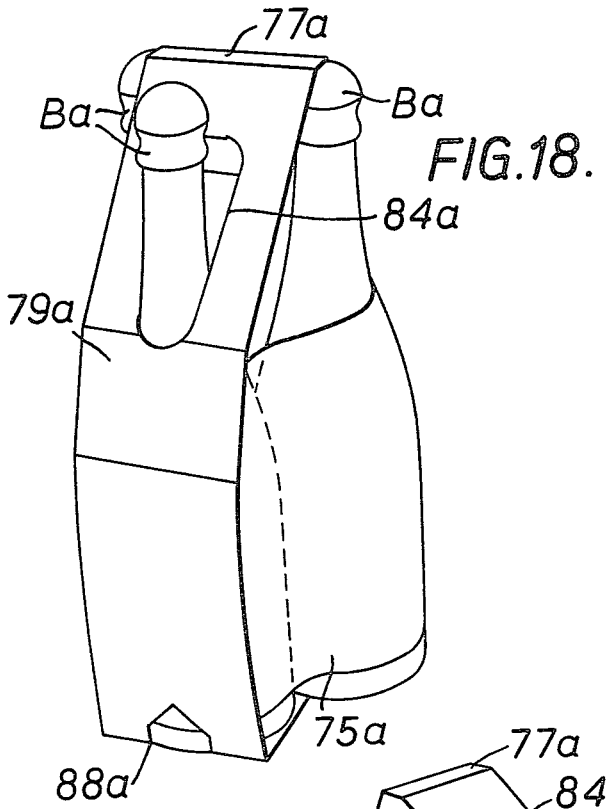
Figure 19:
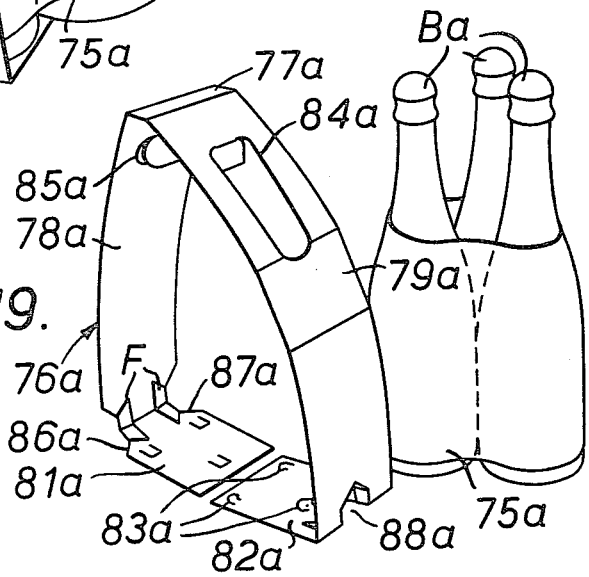

Some embodiments of the invention will now be described, by way of example, with reference to the accompanying drawings, in which:

FIG. 1 shows a clustered unit of four plastics bottles together with a paperboard blank for forming a wrap-around outer sleeve, FIG. 2 is a plan view of a mid-section of the wrap-around outer sleeve which can be formed to provide a handle for the package, FIG. 3 is a plan view of one end of the outer sleeve incorporating a tear-away strip and a locking element by which the ends of the sleeve are connected together, FIG. 4 illustrates the opposite end of the outer sleeve including a further cooperating locking tab, FIG. 5 illustrates the wrap-around outer sleeve partially applied to the clustered unit of four bottles, FIG. 6 is a perspective view of the clustered unit and wrap-around outer sleeve connected together to form the completed package, FIG. 7 is a plan view of the centre section of a modified outer sleeve showing detail of the handle construction, FIGS. 8 and 9 are plan views of the respective ends of the sleeve are connected together, FIG. 10 is a perspective view of the clustered unit of four bottles with the modified outer sleeve applied so as to form the completed package, FIG. 11 illustrates a clustered unit of two bottles together with a further outer sleeve, FIG. 12 is an underside view of the completed package showing the opposed ends of the wrap-around outer sleeve connected together FIG. 13 is a perspective view of the completed package having a clustered unit of two bottles, FIG. 14 is a perspective view of a further type of multi-unit package incorporating a wrap-around outer sleeve, FIG. 15 is a perspective view of a multi-unit package comprising two tiers of containers connected together by a wrap-around outer sleeve, FIG. 16 is a perspective view of a further package comprising a clustered unit of three bottles with a wrap-around outer sleeve, FIG. 17 is a perspective view of the clustered unit of FIG. 16 removed from the outer sleeve, FIG. 18 is a perspective view of a further package comprising a clustered unit of three bottles provided with a modified outer sleeve, and FIG. 19 is a perspective view of the clustered unit of FIG. 18 removed from the outer sleeve.

Referring to the drawings, there is shown in FIG. 1 a clustered unit 10 of four plastics bottles 'B' which have been shrink wrapped by a plastics film material 11 closely to hold the bottles secured together in the unit. A perforated line 12 extends across a top surface of the shrink wrapped material between two pairs of the bottles. The other component of the package comprises a paperboard wrap-around outer sleeve and a blank 13 for forming the sleeve also illustrated in FIG. 1. Outer sleeve 13 comprises a waisted central portion 14 for providing a handle section of the sleeve, side wall sections 15, 16 integral with the central waisted portion 14 and disposed on opposite sides thereof and bottom wall panels 17, 18 respectively.

FIG. 2 of the drawings shows the waisted central section 14 of the blank together with adjoining shoulder panels **15*a*, 16*a* respectively. Extending along the length of the blank are three integral strip portions, a central portion 19 and a pair of marginal portions 20, 21 which are integrally hinged to the central portion 19 along longitudinal fold lines 22, 23 respectively. In the handle section 14 the strip portions are of approximately equal widths. However, the fold lines 22, 23 diverge towards the bottom wall panels of the blank whereby the central portion 19 is of increasing width away from the central handle portion 14**.

Integrally hinged to opposite transverse edges of the handle portion 14 along transverse fold lines **24, 24*a* are shoulder panels 15*a*, 16*a* respectively. Shoulder panels 15*a*, 16*a* are integrally hinged to the side walls 15, 16 along transverse fold lines 25, 25*a*** respectively.

FIG. 3 of the drawings shows bottom wall panel 18 of the blank which is integrally hinged to the side wall 16 along a transverse fold line 26. The panel 18 includes a known locking tab 27 which is struck from a projecting tongue **27*a* extending from the free transverse edge of panel 18**.

The longitudinal marginal portions 20, 21 terminate in gusset panels 28, 29 respectively. The gusset panel 28 is integrally hinged to the longitudinal marginal portion 20 and to bottom panel 18 along oblique fold lines 30, 31 respectively. Similarly the gusset panel 29 is integrally hinged to the longitudinal marginal portion 21 and to bottom wall panel 18 along oblique fold lines 32, 33 respectively. The gusset panels 28, 29 provide retaining corners for engagement with the heel of a bottle and reinforce the corners of the outer sleeve.

The opposite bottom wall panel 17 of the blank is illustrated in FIG. 4 of the drawings. Struck from the bottom wall panel 17 is a retaining tab 34 defining an aperture through which the locking tab 27 is forced in order to connect the bottom wall panels 17, 18 together in overlapping relationship. Bottom wall panel 17 also is provided with a pair of gusset panels 28*a*, 29*a* similar to gusset panels 28, 29 respectively described with reference to FIG. 3.

Referring now to FIG. 5 of the drawings it will be seen that the wrap-around outer sleeve 13 is partially assembled to a clustered unit 10 of shrink wrapped bottles. Prior to assembling the outer sleeve 13, the longitudinal marginal portions 20, 21 of the blank are folded inwardly to overlie the longitudinal central portion 19 and secured in position as by glueing so as to provide a multi-ply thickness of material. The outer sleeve is then applied to the unit 10 so that each of the bottom wall panels 17 and 18 are located in overlapping relationship beneath the unit and with the side wall sections 15, 16 extending generally parallel to the vertical axes of the bottles and the handle section 14 bridging the top of the unit at right angles to the perforated line of weakness 12. The overlapped bottom panels 17, 18 are then locked together by engagement between the locking and retaining tabs 27, 34 respectively. The completed package will then appear as shown in FIG. 6 of the drawings in which the clustered unit 10 is overlapped by the wrap-around outer sleeve 13 with the top wall 14 of the sleeve providing a handle by which the package may be carried. As shown in FIGS. 5 and 6 of the drawings, the gusset panels as at 29 bow outwardly when the blank is folded into its wrap-around configuration and so provide added strength to the corners of the outer sleeve whilst at the same time providing a retaining panel for engagement with the heel or chine or a bottle or can respectively.

To facilitate access to the unit, the wrap-around outer sleeve 13 is formed with a tear-away strip 35 extending transversely across the side wall 16. As shown in FIG. 3 of the drawings the tear-away strip 35 is defined by score lines 35*a*, 35*b* struck from the blank.

Referring now to FIG. 7 of the drawings, there is shown the handle portion of a modified wrap-around sleeve 37 formed from a blank of paperboard or similar sheet material for use with a clustered unit similar to unit 10. However, in this embodiment the outer sleeve 37 is of constant width throughout its length. The wrap-around sleeve 37 comprises a (top wall) central handle section 38 comprising integral marginal portions 39, 40 hinged to a central portion 41 along fold lines 42, 43 respectively. The central handle section 38 is integral with side walls 44, 45 which are foldably joined along transverse fold lines 46, 47 respectively.

Referring now to FIGS. 8 and 9 of the drawings, there is shown the bottom wall panels of the blank, 48 and 49 respectively. Bottom wall panel 48 includes a locking tab 50 struck from a projecting tongue 50*a* extending from the free transverse edge of the bottom wall panel 48. Hinged adjacent the longitudinal edges of the panel 48 is a pair of foldable gusset panels 51, 52. Gusset panels 51, 52 are foldably joined to the panel 48 along fold lines 51*a*, 52*a* respectively and include lines of cut 51*b*, 52*b*. Similar lines of cut (not shown) are provided at the opposite ends of the respective gusset panels.

A bottom wall panel 49 has struck therefrom a retaining tab 53 and foldable gusset panels 54, 55 similar to the foldable gusset panels 51, 52 provided in the bottom wall panel 48.

FIG. 10 of the drawings shows the wrap-around outer sleeve 38 applied to the cluster unit 36 from which it will be seen that the marginal portions 39, 40 have been folded about fold lines 42, 43 respectively and overlapped beneath the central portion 41 and secured in position so as to provide a multi-ply thickness of material in the handle section 38. Similarly, the gusset panels 51, 52 and gusset panels 54, 55 have been folded about their respective fold lines and brought into face to face relationship with the inside surface of the sleeve. Thus, a double thickness of material is provided at the four base corners of the wrap-around sleeve.

To facilitate opening the package the wrap-around sleeve 37 may be provided with a tear-away strip as described with reference to the previous embodiment so that one of the side walls 44, 45 may be ruptured.

Referring now to FIGS. 11–13 of the drawings, there is shown a further package comprising the combination of a clustered unit of two bottles provided with a wrap-around outer sleeve 58. FIG. 11 illustrates a clustered unit 56 of a pair of champagne bottles which have been shrink wrapped by a plastics film material 57, together with a wrap-around outer sleeve 58 formed from a blank of paperboard or similar sheet material.

The outer sleeve 58 comprises a pair of side walls 59, 60 which are mirror images of each other about a central top wall 61 integral with both the side walls 59, 60. The longitudinal edges of each of the side walls 59, 60 diverge towards the top wall 61. The wrap-around outer sleeve 58 further comprises bottom closure panels 62, 63 at the unconnected ends of side walls 59, 60 respectively.

FIG. 13 illustrates the wrap-around outer sleeve 58 applied to the clustered unit 56 in which the top wall 61 bridges the shrink wrapped film 57 between the top closures of the bottles so that the side walls 59, 60 extend generally parallel to the longitudinal axes of the bottles, although, of course, the side walls will diverge towards the base of the bottles.

To complete the package the end closure panels 62, 63 are overlapped and connected together by cooperating locking elements 64 as shown in FIG. 12. The triangular apertures such as that designated numeral 65 are provided in each of the bottom closure panels 62, 63 for cooperation with appropriate machine elements so as to tighten the outer sleeve prior to the locking operation by which panels 62, 63 are connected together. This procedure is well known in the art. As shown in FIG. 13, side wall 58 is provided with an ovate opening 66 providing means by which the package can be grasped. The opening 66 includes a foldably joined hand cushioning panel 67. A similar opening and cushioning panel is provided in the opposite side wall 59.

It will be appreciated that the wrap-around outer sleeve 58 not only provides means by which the package can be grasped and carried but also hides the openings present in the plastics shrink wrapped material 57 and, of course, provides a surface on which advertising and other information may be printed.

Referring now to FIG. 14 of the drawings there is illustrated a further embodiment of the invention in which a clustered unit 68 of shrink wrapped bottles is provided with a wrap-around outer sleeve 69. The clustered unit 68 in this case comprises a series of two rows of bottles with six bottles in each row and the wrap-around outer sleeve 69 when fitted adopts a generally rectilinear configuration. In other respects the outer sleeve is similar to the sleeve 13 described with reference to FIG. 1 of the drawings except that the cooperating locking elements may be omitted so that the free ends of the band could, if desired, be adhesively joined together.

FIG. 15 shows a still further embodiment of the invention in which a unit 70 of shrink wrapped bottles comprises an upper tier clustered unit 71 located above and supported on a lower tier clustered unit 72. A wrap-around outer sleeve 73 of paper board or similar sheet material connects together the two tier units 71, 72 and as in the previous embodiments passes over the ends of the unit and provides means by which the package can be carried. Sleeve 73 is substantially similar to the sleeve 69 previously described.

Referring now to FIGS. 16 and 17 of the drawings there is shown a unit 74 of three bottles "B" which have been clustered together to form a unit by means of a band 75 formed from a plastics film material. Band 75 passes circumferentially about the bottles and is shrink fitted to maintain the bottles in close relationship with respect to one another.

The other component of the package comprises a wrap around outer sleeve 76 formed from paperboard or similar foldable sheet material and which comprises a top wall 77, side walls 78 and 79 integrally hinged to the top wall 77 and a bottom wall 80 comprising a bottom wall panel 81 integrally hinged to the lowermost edge of side wall 78 and a bottom wall panel 82 integrally hinged to the lowermost edge of side wall 79. The bottom wall panels 78 and 79 are secured together in overlapping relationship by means of known locking elements 83 as previously described. It is however envisaged that the bottom wall panels 81 and 82 may be secured together by other suitable means, for example, they may be adhesively joined together.

The side wall 79 is formed with an elongate aperture 84 through which the neck portions of one of the bottles 'B' retained by the plastics band 12, protrudes. This feature assists in retaining the clustered unit of bottles within the outer sleeve 76. The opposite side wall 78 is formed with a hand gripping aperture 85 (FIG. 17) adjacent the top wall 77 by which the package may be grasped and carried.

In order to further assist in retention of the clustered unit within the outer sleeve 76 bottle heel retaining apertures 86 and 87 are struck from the lowermost portions of side wall 78 and adjacent portions of the bottom wall panel 81. As shown in FIG. 17 of the drawings the bottle heel retaining apertures 86 and 87 are formed by pressing out flap portions 'F' of the paperboard material which are then brought into overlapping relationship with the internal surface of the side wall 78 and bottom wall panel 81. These flaps 'F' provide additional strength to the outer sleeve in the area of the bottle heel retaining apertures 86 and 87.

A further bottle heel retaining aperture 88 is struck from the lowermost portion of side wall 79 and the adjacent portion of bottom wall panel 82.

Referring now to FIGS. 18 and 19 of the drawings, there is shown a package similar to that shown in FIGS. 16 and 17, and in which like parts are designated like reference numerals with the addition of suffix "a".

However, in this case the outer sleeve 76*a* is of substantially constant width and the bottle heel retaining apertures 86*a* and 87*a* are provided by recesses struck from the side edges of the side wall 78*a*. In other respects the construction is similar to that previously described with reference to FIGS. 16 and 17.

It will be observed that the embodiments of the invention described with reference to FIGS. 1 to 15 employ a plastics film material which substantially encases the containers to form a clustered unit; the embodiments of the invention described with reference to FIGS. 16 to 19 employ a plastics film material comprising a band or sleeve passing around the containers to form a clustered unit. It is envisaged that either of these techniques of forming the clustered unit is suitable for any of the embodiments described.

Although the packages described herein show a plurality of bottles clustered together, it is to be understood that the invention also is applicable to packaging cans or other suitably sized containers. Whilst also the description refers to a band sleeve or an encasing covering of heat shrinkable material applied to the containers to form a clustered unit, it is further envisaged that other suitable materials may be employed to hold the containers clustered together.

I claim:

1. A package comprising a group of primary containers such as bottles or cans, connecting means of plastics film material for holding said containers clustered together to form a unit, an outer sleeve of paperboard surrounding said clustered unit and providing handle means by which the package can be carried, said outer sleeve comprising a top wall extending across the top of said package adjacent the tops of said primary containers, side walls joined to opposite ends of said top wall, and a bottom wall joined to said side walls remote from said top wall and underlying the bases of at least some of said primary containers, characterized in that said top wall comprises a central portion and integrally hinged opposed marginal portions, said marginal portions being folded into overlapping relationship with respect to said central portions to form a multi-ply handle.

2. The package according to claim 1 in which said plastics film material substantially encases said group of containers.

3. The package according to claim 1 in which said plastics film material forms a band passing circumferentially around said group of containers intermediate opposite ends thereof.

4. The package according to claim 1 in which said handle means comprises a hand gripping aperture formed in at least one of said side walls of the outer sleeve adjacent the top wall thereof.

5. The package according to claim 1 in which each of said side walls comprises a central portion and integrally hinged opposed marginal portions, said marginal portions being folded into overlapping relationship in respect to said central portion, to form a double ply thickness of material at the edges of each of said side walls.

6. The package according to claim 1 in which said bottom wall comprises a pair of panels, each of which panels is integrally hinged to respective ones of said side walls and secured together in overlapping relationship.

7. The package according to claim 6 in which a gusset panel is hinged to opposite side edges of each of said side walls and to opposite side edges of each bottom wall panel, so as to provide reinforcement at lowermost corners of the outer sleeve.

8. The package according to claim 1 in which one of said side walls is formed with an aperture adjacent said top wall through which aperture a top portion of at least one container protrudes.

9. The package according to claim 1 in which each side wall is formed with at least one aperture adjacent said bottom wall, in each of which apertures a lower portion of one of said containers is received in order to assist retention of the container unit within said outer sleeve.

10. The package according to claim 1 comprising two clustered units stacked one on the other, whereby said top wall of said outer sleeve overlies the tops of the containers in the uppermost clustered unit, said opposite side walls extend between the tops of the containers in the uppermost unit and the bases of the containers in the lowermost unit, and said bottom wall overlies the bases of the containers in the lowermost clustered unit.

* * * * *